US006688251B1

(12) United States Patent
Salas Peralta

(10) Patent No.: US 6,688,251 B1
(45) Date of Patent: Feb. 10, 2004

(54) VEHICLE OF IMMERSION FORCED BY HYDRODYNAMIC FLOW (VIFHF)

(76) Inventor: Americo Salas Peralta, Avenida Venezuela P3-B Urb. Ucchullo, Cusco (PE)

( * ) Notice: Subject to any disclaimer, the term of this patent is extended or adjusted under 35 U.S.C. 154(b) by 0 days.

(21) Appl. No.: 10/256,366

(22) Filed: Sep. 27, 2002

(51) Int. Cl.[7] ..... B63G 8/00

(52) U.S. Cl. ..... 114/312; 114/337; 114/346; 114/151; 440/40

(58) Field of Search ..... 440/38, 40; 114/312, 114/330, 333, 337, 338, 346, 151; 441/67

(56) References Cited

U.S. PATENT DOCUMENTS

| | | | | | |
|---|---|---|---|---|---|
| 1,281,414 | A | * | 10/1918 | Pegram | 114/316 |
| 2,791,981 | A | * | 5/1957 | Lane | 114/57 |
| 3,391,669 | A | * | 7/1968 | Buster | 340/288 |
| 3,468,276 | A | * | 9/1969 | Pollard et al. | 114/1 |
| 3,493,982 | A | * | 2/1970 | Youngquist | 114/346 |
| 4,494,472 | A | * | 1/1985 | Rougerie | 114/66 |
| 4,730,572 | A | * | 3/1988 | Hollingsworth | 114/283 |

* cited by examiner

*Primary Examiner*—Stephen Avila
(74) *Attorney, Agent, or Firm*—Pendorf & Cutliff

(57) ABSTRACT

A submersible vehicle of diverse use that eliminates the compartments of ballast, and at the same time, has a horizontal displacement system and new direction. The vehicle includes a water pump adapted to generate a flow of water; an admission duct to receive the flow generated by the water pump, the water pump impels the flow of water downward to a circular duct located at the admission duct producing a high speed current; a secondary unit of propulsion for helping with the horizontal displacement of the vehicle, the secondary propulsion comprises four nozzles installed at 90° on top or side of the vehicle, the nozzles receive the flow generated by the water pump, and the exit of the flow produces the horizontal displacement; at least one electromagnetic valve installed before each nozzle, each electromagnetic valve controls the exit flow independently, wherein each electromagnetic valve is controlled by the pilot of the vehicle, wherein different combinations of exit flow produce different combinations of impulse in the four nozzles which provide the horizontal displacement in any direction; a cockpit for transporting passengers; a protective cover installed under the cockpit, the double circular cover protects the circular wing and directs the flow to the inferior part of the vehicle. The maneuverability and stability of the vehicle can be changed by changing the angle of attack of each section of the circular wing.

10 Claims, 3 Drawing Sheets

CUT PLAN VIEW

Fig. 1a
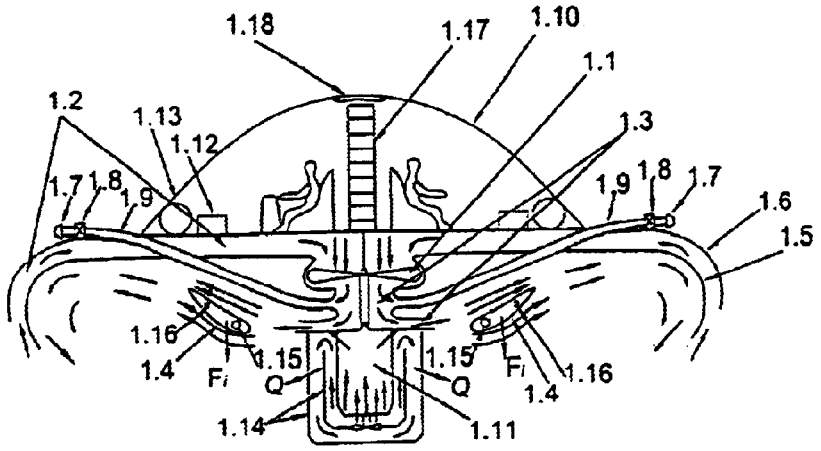
CUT PLAN VIEW
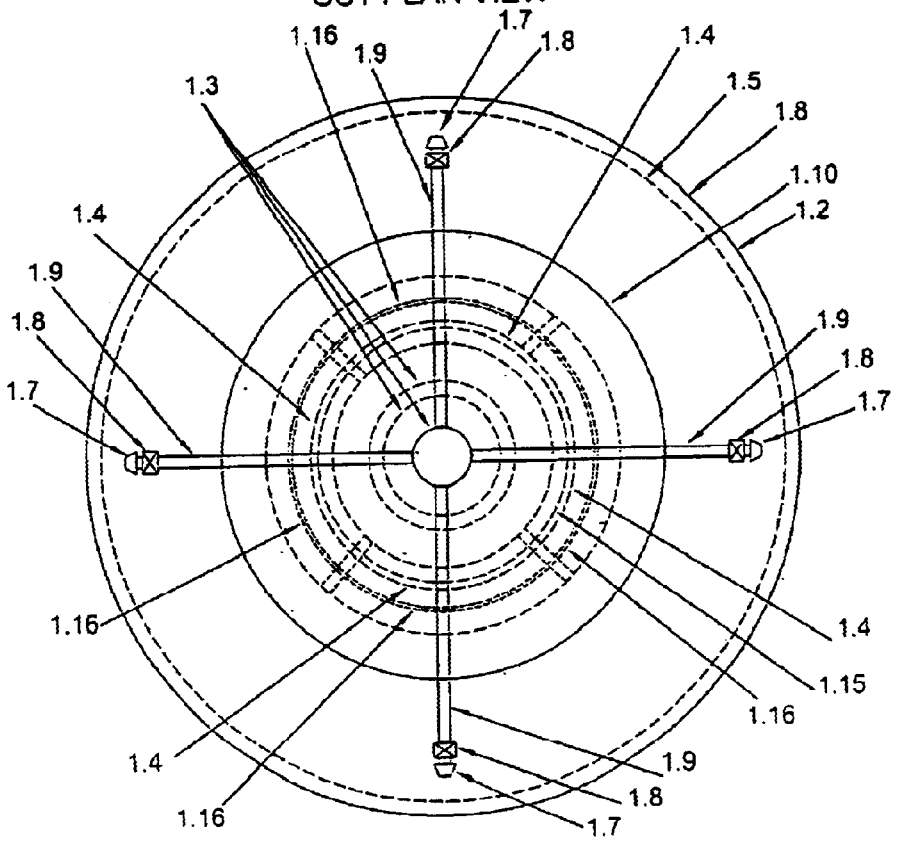
TOP PLAN VIEW
FIG. 1 - VEHICLE OF INMERSION FORCES BY HYDRODINAMIC FLOW (VIFHF)
Fig. 1b

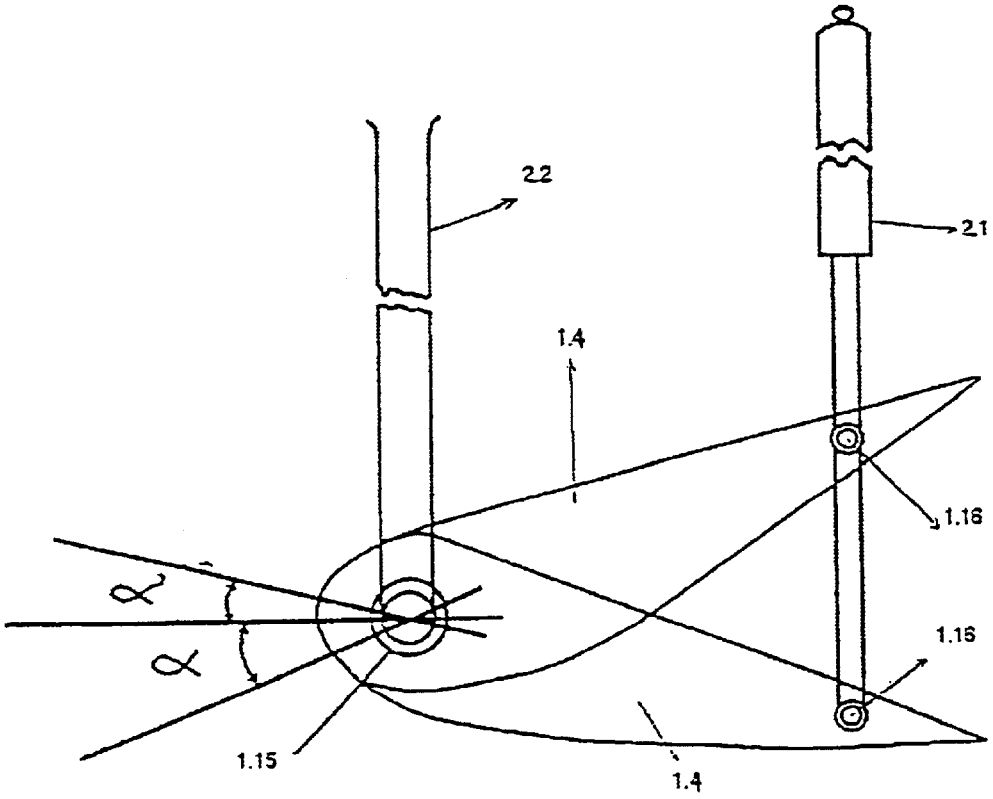
$\alpha$ = ANGLE OF ATTACK USUAL (2-12°) "POSITIVE"
$\alpha'$ = "NEGATIVE" ANGLE OF ATTACK
FIG. 2 – VARIABLE ANGLE OF ATTACK OF THE CIRCULAR WING

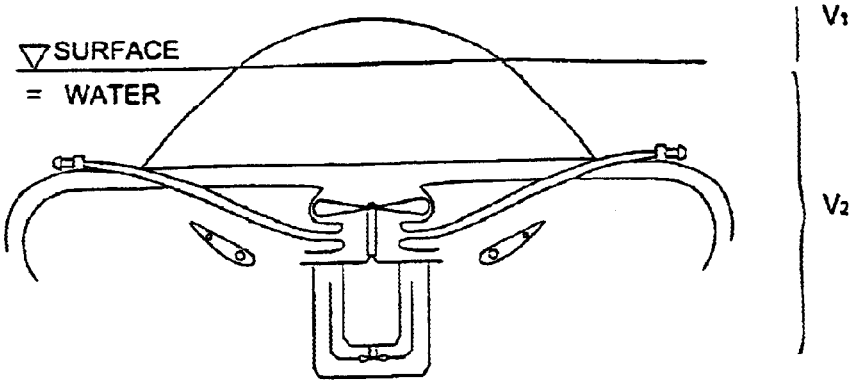
FIG. 3 - VIFHF STABLE ON SURFACE
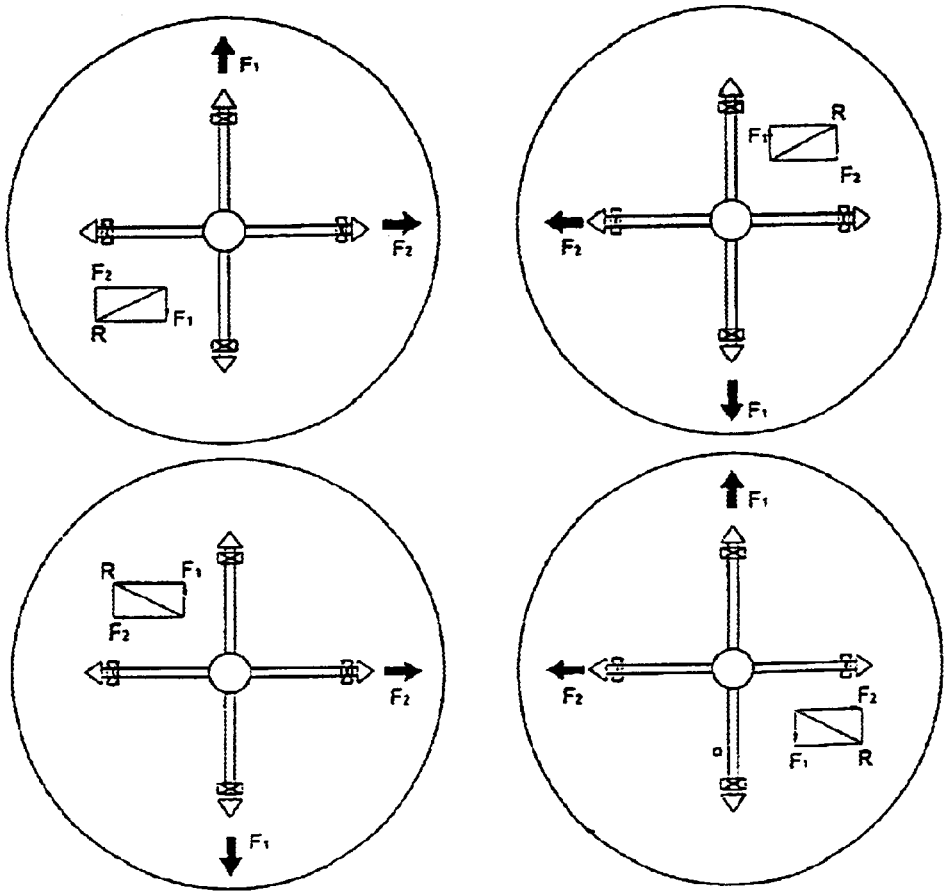
FIG.- 4 VARIABLE HORIZONTAL DISPLACEMENT

VEHICLE OF IMMERSION FORCED BY HYDRODYNAMIC FLOW (VIFHF)

BACKGROUND OF THE INVENTION

1. Field of the Invention

The present invention concerns submersible vehicles. More specifically, a submersible vehicle that eliminates the compartments of ballast, and at the same time, has a horizontal displacement system and new direction.

2. Description of the Related Art

Submersible vehicles are able to move under the water in general due to several systems: the system of immersion and stabilization, the system of impulsion or advance, and the system of direction. The first of these systems includes watertight compartments within the ship, which must fill or drain with the ballast that normally is water taken from the surroundings. Initially, the ship is floating in the surface with the empty ballast compartments, due to the Principle of Archimedes, that stipulates that all body in fluid suffers a towing traction force upwards, equal to the product of the specific weight of the fluid by the submerged volume. That is, to be in balance in the surface at the beginning, the gross weight of the ship is equal to the push. In order to overcome this push, the watertight compartments of the submersible are flooded with water, altering the balance, and submerging therefore the vehicle.

The compartments are properly distributed throughout the submersible, so that once the wished depth is reached, the ballast can be pumped from one to another, in order to obtain the necessary stability (For example, the ballast water is pumped from the prow compartment to the aft compartment to recover the horizontal position at the end of the immersion).

Nowadays, the operations oriented to obtain the stability of the ship take place automatically, using level sensors that transfer ballast among compartments according to the way the requirements of the operation of the ship appear.

In addition, the current vehicles have stabilizing planes that install transversal to the flanks of the ship, which contribute to stabilize because they can turn in an angle around its axis.

In order to emerge, as it is logical, it is necessary to expel the ballast from the watertight compartments, in order to recover the buoyancy of the vehicle. This is obtained using pressured air, with which the water is expelled outside from the ballast, with the consequent consumption of energy since it is necessary to push the exterior pressure. This consumption of energy is high if it is considered that the pressure to a meter of depth is of 1000 kg/m2, and it increases in 1000 kg every meter downwards.

The system of impulsion or advance of the ship is made of one or more outer helices located in the stern of the vehicle, which receive the movement of the power plant located within the boat.

The direction system includes a rudder similar to one of the boats of surface and in smaller vehicles, helices of position and variable speed that directs the trajectory of the submersible.

SUMMARY OF THE INVENTION

The invention, here proposed, simplifies the design of the current vehicles of immersion when it eliminates the compartments of ballast proposing a horizontal displacement system and new direction.

It is an application of the principle of sustentation of the wing of an airplane used in an inverse way to obtain the immersion of a submersible vehicle. The vehicle is designed so that in rest, it floats in balance on the water surface, forcing its immersion as it is explained: The water current generated by a water pump is directed towards a circular wing through a duct also circular.

The circular wing has in cut the shape of the wing of an airplane, but it is installed in an inverse position, so that instead of generating a force upwards, it generates a force downwards. The circular wing is segmented in four movable sections that can turn around a circular unitary axis, as hinges, in order to modify the angle of attack respect to the water flow received from the circular duct. This hinge movement is synchronous or independent for the four sections, according to the necessities of stability of the vehicle.

The horizontal movement is generated, taking pressured water after the propelling from the water pump, and leading it towards the four nozzles located to 90° in the outer part of the vehicle. Before each nozzle, an electromagnetic valve is placed with which the flow is regulated to be expelled by the nozzle.

A synchronous control of the four valves commanded by the pilot of the vehicle allows obtaining diverse combinations of impulse in the four nozzles, obtaining therefore a horizontal displacement in any direction.

When it is desired to emerge, it will be enough to stop the pump, with which, the force, that forces the vehicle to descend, will disappear, recovering its initial buoyancy. If it is desired to emerge quickly, the pump should be kept working, but a negative angle of attack will occur to the four sections of the circular wing, that is below the flow plane originated in the circular duct, obtaining therefore an additional ascending force.

Under the cockpit, the vehicle has one double circular cover, to allow a free water passing towards the suction of the pump and protecting the action from the pressured water on the circular wing, of the opposite effect generated by the horizontal displacement of the vehicle and by any current that could be present in the surroundings. The water is directed by the cover towards the bottom of the vehicle.

As it is evident, in case of any type of error, the vehicle will automatically rise to the surface, contributing therefore a remarkable new factor of safety in immersion vehicles.

BRIEF DESCRIPTION OF THE DRAWING

FIG. 1*a* shows the vehicle of Forced Immersion by Hydrodynamic Flow (VFIHF).

FIG. 1*b* shows a top view of the vehicle of Forced Immersion.

FIG. 2 shows a section view of a segment of the circular wing with an angle for immersion ($\alpha$) and an angle for fast emersion ($\alpha'$).

FIG. 3 shows (VFIHF) in balance on the surface.

FIG. 4 shows four views of the range of displacement of horizontal directions due to flow control of pressured water exit to the nozzles controlled by the pilot with electromagnetic valves from the cockpit.

DETAILED DESCRIPTION OF THE INVENTION.

The VIFHF is an immersion vehicle that is able to submerge in aquatic means following the principle of sustentation of the airplane wing, but in an inverse way: It has a water pump that generates a flow or water current that is radially directed by a circular duct towards a hydrodynamic wing also circular to produce a descendent vertical force that overcomes the buoyancy of the vehicle.

The generating unit of flow or water pump 1.1 is located in the central part of the vehicle. This pump takes water from the central and upper part, where it gets through the admission duct impelling it downwards, generating a flow or current, which is directed by means of a circular duct 1.3, that changes its direction in a straight angle and it radially leads towards a circular wing 1.4, located on the bottom of the vehicle, where the mentioned descendent vertical force takes place. The circular duct has a reduced section radial exit to accelerate the flow that overcomes on the circular wing.

The circular wing has the hydrodynamic characteristics necessary to obtain the wished effect, that is, in a transversal section it has a tear shape, with the longest edge downwards, and an angle of attack respect to the flow.

The wing 1.4 is divided in four sections; the angle of attack ($\alpha$) of these sections can be varied independently or in a synchronous way, with the purpose of maintaining the stability of the vehicle among external flows that hit or control the descent velocity. For that reason, the wing 1.4 is set up in a unitary fixed and tubular circular axis 1.5, being able to turn as a hinge around it.

It also has a segmented secondary circular axis 1.16 on which hydraulic pistons act to obtain the movement of the four sections.

These hydraulic pistons act with oil; its pressure is generated by an electrical hydraulic pump that is fed with energy originated in the storage cells. It is possible to mention that the angle of attack of the wing can be varied beneath or underneath the horizontal plane of the water flow, that is, while the wing remains over this plane, a descendent force will take place, but when locating underneath, an aviation lift will take place that can be used for an emersion at greater speed when it is required.

The title of the invention includes the terms "forced immersion" because the vehicle is forced to submerge by the descendent force generated in the wing by the hydrodynamic flow that affects the wing. As it is evident, the VIFHF does not require an admission system and ballast evacuation for the immersion and emersion as it happens in the current submarine vehicles.

The produced descendent force in the wing is a consequence of the flow that affects the wing, which is mounted circularly in a geometrically inverse way (Shape and wing angle of attack) to the wing of an airplane, generating therefore an effect in opposition to the ascent, that is, a force downwards.

The descendent force generated in the wing should be great that overcomes the buoyancy of the vehicle.

According to the Principle of Archimedes, all body submerged in a fluid is submerged to an aviation lift (Push) proportional to the specific weight of the fluid (specific weight of the water=1 Kgf/dm3) and to the displaced volume by the body (Push=specific weight of means by displaced volume). In the case of the VIFHF, it is considered that being in the surface, there will be a volume (V1) that remains outside the water, for the maneuvers of entrance and exit of crew or load, while the rest of the vehicle (V2) will remain under the surface. Therefore, in rest, the immersed volume (V2) should be calculated in such a way that the gross weight of the vehicle is equal to the push generated by this submerged volume, so that a balance exists, and the vehicle floats among two waters with the V1 on the surface. Once the vehicle is loaded, the descendent force generated in the wing by the hydrodynamic flow should be greater to the push generated by the entire vehicle (V1+V2), obtaining therefore the immersion (FIG. 3).

The value of the descendent force in the wing depends on the angle of attack, surface of the wing, and speed of the hydrodynamic flow, factors that depend on the design, according to the size of the unit that is desired to make.

The energy source, as it is usual in vehicles like the present, will be the electrical storage cells that will always be selected according to the application, size, and unit autonomy, being able to be reload periodically.

For the horizontal displacement, the vehicle has four ducts located every 90°, which take part of the flow generated by the pump so that when leaving through the nozzles, located in each end of the vehicle, they could move horizontally. Each duct has an electromagnetic valve that controls the exit flow independently, so that different combinations of water exit are handled from the cockpit in order to obtain the most convenient direction (FIG. 4).

In case of requiring greater speeds of horizontal displacement, outer units of helix can be mounted as they are currently in use, or a rudder can be placed instead.

The vehicle has a cockpit 1.10 for the crew, controls, load, and accessories.

The armored deck 1.5 is located to a radial distance, enough for not interfering the effect of the hydrodynamic flow on the wing, leading the worked waters towards the bottom of the unit.

In addition, this cover also protects the wing and the flow on it from the external currents generated by the displacement of the vehicle or the existing conditions in immersion means.

Upon the armored deck, there is a cover, with the purpose of creating a duct among both, or a water admission via towards the pump.

The water pump should be selected according to the size of the vehicle. It could be a mixed pump, so that it provides pressure and volume to the exit. For example, a Kaplan pump can be used.

The flow generating water pump is driven by an electrical motor, for its refrigeration, the inclusion of one double capsule around the motor, has been considered, with the purpose of creating a current of air circulation of the cooling air, forced by the helix of the electrical motor. The air transfers the heat (Q) absorbed from the middle of the motor to the surroundings through the wall of the outer capsule 1.14.

The submersible vehicle, according to the present invention, submerges in aquatic means thanks to a water current that affects on a circular hydrodynamic wing, where an immersion force is generated (Fi) that overcomes the buoyancy of the vehicle. This immersion force takes place because the circular wing is installed geometrically inverse to the wing of an airplane, taking place downward force. The circular wing has the shape of a tear and an angle of attack ($\alpha$) respect to the water flow.

The circular wing is divided in four sections that can move around a unitary circular axis as hinges, thanks to a system of hydraulic pistons that receive pressure of an electrical hydraulic pump. The hydraulic pistons are connected to a segmented circular axis in each section of the circular wing. This hinge movement can be synchronous for the 4 segments or independent in each one and serves to keep stability of the vehicle against external factors.

The angle of attack (α) of the wing respect to the water flow can be varied from the cockpit by the pilot, according to requirements of a higher or lower speed of immersion and according to the needs of the vehicle. The angle of attack can be "negative," that is, below the plane of incidence of the water flow when it is required to accelerate the emersion of the vehicle.

The vehicle is calculated so, that in rest, it floats in the surface. To overcome this buoyancy, an electrical motor moved by storage cells is a must, which drives a water pump that generates a current of suitable volume and pressure so that, it is lead by a circular duct where the immersion force is generated (FI) that submerges the vehicle.

As it is evident, dealing with a forced immersion, the submersible does not require filling or emptying the ballast tanks to obtain the immersion or emersion. When stopping the motor, the vehicle will emerge by itself towards the surface. The water pump will have to be selected according to the dimensions of the vehicle; a mixed pump is a must, that is, it has to provide pressure and volume simultaneously.

The vehicle has an armored deck that is located to a distance sufficient not to interfere with the effect of the water current on the circular wing and to lead the worked water towards the bottom part of the vehicle.

Additionally, this cover acts to isolate the circular wing of derived effects from the horizontal displacement or of outer effects to the vehicle as submarine currents. The vehicle also has a cover in order to create between this and the armored deck a circular duct free of admission water towards the pump.

The vehicle has for its horizontal displacement four ducts of pressured water exit that take the water after the pump and finish everyone in respective nozzles. Before each nozzle, there is an electromagnetic valve. The electromagnetic valves are controlled by the pilot from the cockpit, being possible to control the flow voluntarily. With the combination of these flows, a horizontal displacement in any direction can be obtained.

In case it is necessary, the design of the vehicle allows installing additional units of horizontal propulsion in the outer part of the vehicle, and they can be helices of variable position and a directional rudder. These accessories are commonly used in vehicles of these types of submersibles.

The vehicle has a cockpit for passengers and load, where the necessary accessories are; the storage cells, tanks of oxygen, hydraulic pump and others. For the cooling of the main motor, there is a double capsule around it, to cool this motor by means of heat transference (Q) of forced air to run around the helix of the motor with surrounding means.

The circular hydrodynamic wing, when receiving a water flow with pressure and speed produced by a pump, generates a force of immersion that overcomes the buoyancy of the vehicle, due to being installed on a geometrically position inverse to the wing of an airplane.

The armored deck isolates the work of the water flow on the circular wing and of outer factors.

The cover forms a duct of water admission towards the generating pump of flow.

The circular duct directs the water flow towards the circular wing, changing its direction in 90° and increasing its speed when having an opening of reduced exit.

The deriving pressured water exiting the pump is directed towards the 4 nozzles, whose flow is regulated by electromagnetic valves from the cockpit, to obtain the desired direction of horizontal displacement.

Reference Numbers:

1.1—water pump
1.2—water admission duct to the pump
1.3—circular duct
1.4—segmented circular wing
1.5—armored deck
1.6—cover
1.7—nozzles
1.8—electromagnetic valve
1.9—exit duct with pressured water
1.10—cockpit
1.11—electrical motor
1.12—storage cells
1.13—oxygen tanks
1.14—double capsule for cooling the motor
1.15—circular unitary tubular axis
1.16—segmented secondary circular axis
1.17—stairs
1.18—hatchway
2.1—hydraulic piston (two per each wing segment)
2.2—structural support (two per each wing segment)

What is claimed is:

1. A submersible vehicle of diverse use, the vehicle having a top, a bottom, and a side and further comprising:

a water pump adapted to generate a flow of water;

an admission duct to receive the flow generated by the water pump, wherein the water pump impels the flow of water downward to a circular duct located at the admission duct producing a high speed current;

a circular wing located at the bottom of the vehicle, the circular wing directly receiving the high speed current and producing a descendent vertical force that overcomes the buoyancy of the vehicle, the circular wing having a traverse profile and an angle of attack (α) divided in four sections, the circular wing being able to move independently or synchronized for each of the four sections in which it is divided;

a secondary unit of propulsion for helping with the horizontal displacement of the vehicle, wherein the secondary propulsion comprises four nozzles installed at 90° on top or side of the vehicle, wherein the nozzles receive the flow generated by the water pump, and the exit of the flow produces the horizontal displacement;

at least one electromagnetic valve installed before each nozzle, each electromagnetic valve controls the exit flow independently, wherein each electromagnetic valve is controlled by the pilot of the vehicle, wherein different combinations of exit flow produce different combinations of impulse in the four nozzles which provide the horizontal displacement in any direction;

a cockpit for transporting passengers;

a protective cover installed under the cockpit, the double circular cover protects the circular wing and direct the flow to the inferior part of the vehicle;

wherein the maneuverability and stability of the vehicle can be changed by changing the angle of attack of each section of the circular wing.

2. A submersible vehicle, according to claim 1, wherein the circular wing is installed on a geometrically position inverse to the wing of an airplane.

3. A submersible vehicle, according to claim 1, wherein the circular wing has a tear shape with the longest edge downwards, and an angle of attack respect to the flow.

4. A submersible vehicle, according to claim 1, wherein the circular wind further comprises a segmented secondary circular axis on which hydraulic pistons act to obtain the movement of the four sections.

5. A submersible vehicle, according to claim 1, wherein the circular duct includes a narrow exit to produce the high-speed flow.

6. A submersible vehicle, according to claim 1, wherein in order to emerge the vehicle, the water pump is turned off.

7. A submersible vehicle, according to claim 1, wherein an electrical motor drives the water pump.

8. A submersible vehicle, according to claim 1, further comprising two hydraulic pistons in each of the sections of the circular wing for giving movement to each of the sections of the circular wing.

9. A submersible vehicle, according to claim 1, further comprising at least one helix to provide greater speed of horizontal displacement.

10. A submersible vehicle according to claim 1, wherein in order to emerge the vehicle, the water pump is turned on, and the angle of attack is negative.

* * * * *